United States Patent [19]

Kuroda et al.

[11] Patent Number: 4,607,245

[45] Date of Patent: Aug. 19, 1986

[54] GAS INSULATED ELECTROMAGNETIC INDUCTION APPLIANCE

[75] Inventors: Yutaka Kuroda, F-204, 3-17, Sakuragaokaa 1-chome; Yoshio Yoshida, No. 8, Sakuragaoka 3-chome, both of Mino-shi, Osaka; Yuichi Kabayama, 18-5, Fujigao 6-chome, Katano-shi, Osaka, all of Japan; Tsugio Watanabe, Ako, Japan; Tetsuro Hakata, Ako, Japan; Takahiro Matsumoto, Ako, Japan

[73] Assignees: Mitsubishi Denki Kabushiki Kaisha, Tokyo; Yutaka Kuroda, Osaka; Yoshio Yoshida, Osaka; Yuichi Kabayama, Osaka, all of Japan

[21] Appl. No.: 699,127

[22] Filed: Feb. 7, 1985

[30] Foreign Application Priority Data

Feb. 9, 1984 [JP] Japan ..... 59-22649

[51] Int. Cl.[4] ..... H01F 27/08

[52] U.S. Cl. ..... 336/57; 174/11 R; 174/15 R; 336/58

[58] Field of Search ..... 174/11 R, 15 R; 165/104.33, DIG. 14; 336/55, 57, 58, 61; 361/36, 37

[56] References Cited

U.S. PATENT DOCUMENTS 3,371,298 2/1968 Narbut ..... 336/57
4,100,366 7/1978 Mears ..... 174/15 R
4,117,525 9/1978 Moore ..... 336/57 X
4,149,134 4/1979 Kothmann et al. ..... 336/57

FOREIGN PATENT DOCUMENTS 1089879 9/1960 Fed. Rep. of Germany .
46173 12/1975 Japan .
56-107525 8/1981 Japan .

*Primary Examiner*—Thomas J. Kozma
*Attorney, Agent, or Firm*—Oblon, Fisher, Spivak, McClelland & Maier

[57] ABSTRACT

A gas insulated electromagnetic induction appliance in which a non-condensing insulating gas and a condensing insulating coolant are confined, comprises (a) a pressure detector for detecting a pressure within the container vessel; (b) a gas reservoir connected to the container vessel through a gas discharging passageway including a pipe line, a first gas valve, a compressor, and a gas diffuser; a gas feeding passageway including a pipe line and a second gas valve; and a liquid feeding passageway including a pipe line and a liquid valve; (c) a definite quantity of insulating coolant confined in the gas reservoir; (d) a liquid surface detector for detecting a quantity of the insulating coolant in the gas reservoir; and (e) control means which controls the gas valve, the liquid valve, and the compressor to thereby regulate a pressure in the container vessel and a quantity of the liquid in the gas reservoir.

4 Claims, 4 Drawing Figures

GAS INSULATED ELECTROMAGNETIC INDUCTION APPLIANCE

The present invention relates to a gas insulated electromagnetic induction appliance, and, more particularly, it is concerned with a gas insulated electromagnetic induction appliance comprising a gas pressure regulating means, and having functions of insulation and cooling within its operating temperature by accommodating a main body of the electromagnetic induction appliance in a container vessel, in which a non-condensing insulating gas and a condensing insulating coolant are confined.

In the following, explanations will be given by taking a gas insulated transformer as an example, for the sake of simplicity in description.

There are various systems in the gas insulated transformer such as a system, in which both insulation and cooling are carried out with a single kind of a non-condensing gas; a system, in which a condensing coolant which is liquid at a normal temperature and under a normal pressure is added to the first-mentioned system, and the liquid coolant is sprayed over, or flown down on and along the winding and the iron core of the transformer; and others.

The dielectric strength of such gas insulated transformer has a close relationship with a pressure of the insulating gas or vaporized coolant gas to be sealed in the container vessel. If the gas pressure at the time of operating the appliance is taken high, the dielectric strength becomes high with the consequence that the insulation size can be reduced, hence the main body of the apparatus can be made small, in contrast to which a wall thickness, a weight, etc. of the container vessel for the appliance should inevitably be made large in order for the container to be durable against high pressure. On the other hand, if the pressure is made very low, the wall thickness, the weight, etc. of the container vessel can be reduced, but its dielectric strength becomes low and the insulating size increases with the result that the main body of the appliance becomes inevitably large. Accordingly, the appliance is required to be operated in an appropriate pressure range.

There have so far been various systems, in which an insulating gas is sealed in advance in a container vessel in such a manner that a pressure of an insulating gas or a pressure of a mixed gas of the insulating gas and evaporated coolant gas at the maximum operating temperature of the apparatus may not be higher than the upper limit value as set, and no pressure regulation is done during the operation of the appliances; or in which a separate gas storage tank is provided besides the container vessel for the appliance main body, and a part of the insulating gas or the mixed gas is discharged into the gas storage tank when the temperature and the pressure in the container vessel are high, thereby regulating the interior of the container vessel at a definite pressure or lower; and so forth. The present invention belongs to the latter system of regulating the pressure.

FIG. 1 of the accompanying drawing illustrates a conventional pressure control, gas insulated transformer (vide: examined Japanese utility model publication No. 46173/1975). In the drawing, an insulating coolant 3 which has a high boiling point and assumes a liquid form at a normal temperature is confined in a container vessel 1 which accommodates therein a main body 2 of a voltage transformer and is tightly closed.

Also, an insulating gas 4 which has a boiling point lower than the insulating coolant 3 and vaporizes at a normal temperature is confined in it. A high pressure detector 5 and a low pressure detector 6 are provided in the interior of the container vessel 1. On the lateral side of the container vessel 1, there is disposed a gas storage tank 7 with a liquid surface detector 8 being provided therein. The gas reservoir 7 is communicatively connected at its top part with the top part of the container vessel 1 through a compressor 9 and a gas valve 10. The bottom part of the gas storage tank 7 is communicatively connected with an upper part of the container vessel 1 through a liquid valve 11. Further, the high pressure detector 5 is so constructed that it may drive and control the compressor 9 and the gas valve 10 simultaneously when it detects a pressure having reached a predetermined value and above, and that it may control the liquid valve 11 to open, when the low pressure detector 6 detects the pressure within the container vessel having lowered to a predetermined value or below.

The conventional gas insulated transformer is constructed as mentioned above, and, in the state of the transformer being in stoppage of its operation, the temperature within the container vessel 1 is low and the insulation is principally maintained by the insulating gas which has a low boiling point and has been vaporized. When the transformer is operated and the temperature in the container vessel 1 rises, the liquid insulating coolant 3 having a high boiling point and staying at the bottom part of the container vessel tends to be vaporized with the consequent cooling of the transformer main body 2 by heat of vaporization simultaneously with insulation of the main body. At this instant, the pressure in the container vessel 1 also rises, whereby the high pressure detector 5 is actuated to open the gas valve 10 and to drive the compressor 9 simultaneously to send out a mixed gas of the insulating gas 4 in the container vessel 1 and the evaporated insulating coolant 3 into the gas storage tank 7 until the inner pressure of the container vessel lowers to a predetermined value, and to close the gas valve 10 to stop driving of the compressor 9 by the operation of the high pressure detector 5 as soon as the interior of the container vessel returns to a predetermined pressure value. On the other hand, of these gases sent into the gas reservoir 7, the gas of the insulating coolant 3 having a high boiling point is forced to liquefy by a pressure increase in the gas reservoir 7 by the compressor 9 and heat discharge from the gas reservoir 7, and collects at the bottom part of the gas reservoir 7. When the quantity of the liquefied gas reaches a predetermined level, the liquid surface detector 8 is actuated to control the liquid valve 11 to open, and the insulating coolant 3 in liquid form is ejected into the container vessel 1 by the inner pressure of the gas reservoir 7, until the inner pressure of the gas storage tank 7 reaches a predetermined level or lower. As soon as the inner pressure reaches the predetermined value or lower than that, the liquid valve 11 is again closed. In this way, the above-described operations are repeated by means of the high pressure detector 5 and the liquid surface detector 8, whereby a fluorine compound refluxes between the container vessel 1 and the gas reservoir 7 to constantly maintain the inner pressure of the container vessel 1 at a definite value. In the meantime, the insulating gas 4 tends to collect at the upper part of the gas reservoir 7 in its gaseous form.

In the case of a load applied to the transformer decreasing gradually, the pressure within the container vessel 1 also lowers gradually, and, as soon as the inner pressure reaches a predetermined value or lower than that, the low pressure detector 6 is actuated to open the liquid valve 11 irrespective of the liquid quantity, and to send the insulating gas 4 having a low boiling point in the gas reservoir 7 back into the container vessel 1, thereby preventing decrease in the inner pressure thereof.

However, since the above-described conventional device is of such a system that stores an insulating gas having a low boiling point in its gaseous form in the gas storage tank 7 when the interior of the container vessel 1 is at a high temperature, it has various disadvantages such that, if the transformer becomes larger in size, the quantity of the gas to be discharged or stored increases with the consequence that the gas reservoir 7 becomes inevitably large in volume, or, in order to prevent such undesirable phenomenon, the compressive force of the compressor 9 and the pressure withstand of the gas storage tank are required to be increased, and so forth.

It is therefore an object of the present invention to provide a gas insulated electromagnetic induction appliance which has solved those various disadvantages of the conventional appliance as mentioned in the foregoing.

It is another object of the present invention to provide a gas insulated electromagnetic induction appliance having a gas reservoir of a small capacity, a compressor of a low compressive force, and a gas pressure regulator applicable to an electromagnetic induction apparatus of a large capacity.

According to the present invention, in general aspect of it, there is provided a gas insulated electromagnetic induction appliance which carries out insulation and cooling, within an operating temperature, of an main body principally composed of a winding and an iron core housed in a container vessel, in which a non-condensing insulating gas and a condensing insulating coolant are confined, said electromagnetic induction appliance being characterized by comprising: (a) pressure detector for detecting a pressure within said container vessel; (b) a gas reservoir connected to said container vessel through a gas discharging passageway including a pipe line, a first gas valve, a compressor, and a gas diffuser; a gas feeding passageway including a pipe line and a second gas valve; and a liquid feeding passageway including a pipe line and a liquid valve; (c) a definite quantity of insulating coolant confined in said gas reservoir; (d) a liquid surface detector for detecting a quantity of said insulating coolant in said gas reservoir; and (e) control means which controls said gas valve, said liquid valve, and said compressor to thereby regulate a pressure in said container vessel and a quantity of the liquid in said gas reservoir.

The foregoing objects, other objects as well as the specific construction, operations, and resulting effect of the gas insulated electromagnetic induction appliance according to the present invention will become more apparent and understandable from the following detailed description thereof, when read in conjunction with the accompanying drawing showing a couple of preferred embodiments thereof.

In the following, the present invention will be described in detail in reference to the accompanying drawing.

Figure 1:
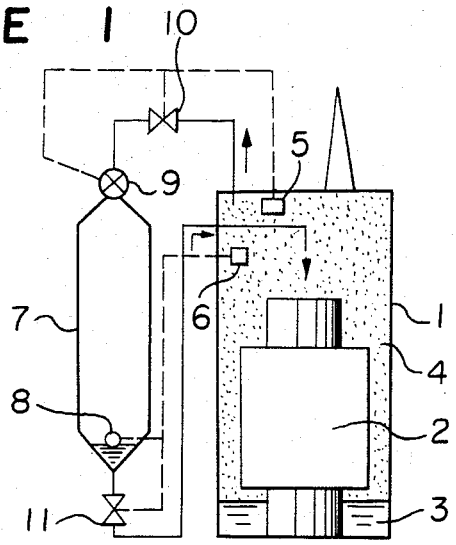
FIGURE 1 PRIOR ART
FIG. 1 is a schematic view partly in longitudinal cross-section of a conventional gas insulated transformer.
Figure 2:
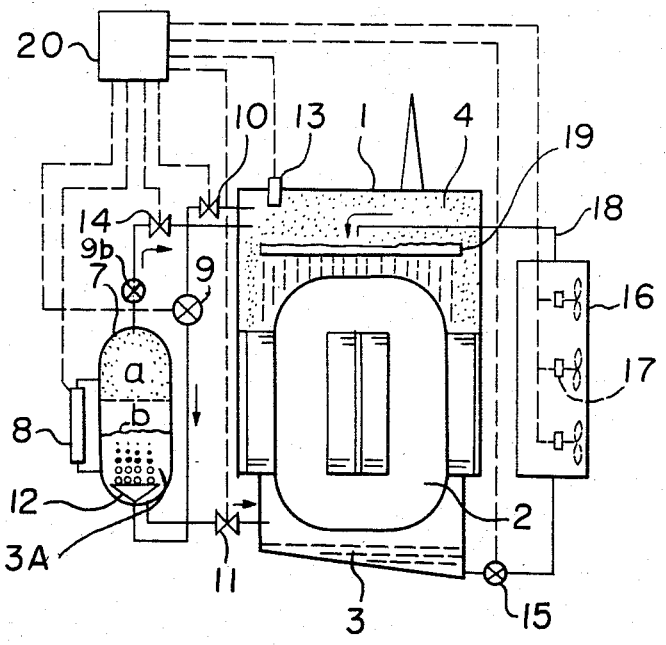
FIG. 2 is also a schematic view partly in longitudinal cross-section of one embodiment of a gas insulated transformer according to the present invention.

FIG. 2 illustrates one preferred embodiment of the present invention. In the drawing, reference numerals 1 to 4, 7 to 11 designate the same or corresponding parts as those in FIG. 1. An insulating coolant 3A same as the insulating coolant 3 is confined in the gas storage tank 7 in a definite quantity. The gas reservoir 7 is provided with a gas diffuser 12, and the container vessel is provided with a pressure detector 13. A reference numeral 14 designates a gas valve. Numerals 15 through 19 are those component members constituting the cooling system for a large capacity transformer, in which 15 refers to a pump for circulating the liquid insulating coolant, 16 denotes a cooling device, 17 a cooling fan, 18 a coolant circulating pipe line, and 19 a coolant diffuser. The insulating coolant 3 circulated by the pump 15 is sprayed by means of the coolant diffuser 19 over the transformer main body 2 principally constructed with a winding and an iron core, and, while cooling the main body, it drops down to the bottom part of the container vessel 1. And, in the course of its being circulated again by the liquid coolant circulation pump 15, the coolant passes through the cooling system 16 and is cooled by the cooling fan 17 provided therein to discharge heat from the transformer main body 2 outside of the system. By the way, a reference numeral 20 designates a control device.

In the following, operations of the cooling system for the electromagnetic induction appliance will be explained.

While the gas insulated transformer is in stoppage of its operation, or in operation with no load or a light load, temperature in the container vessel 1 is low and a vapor pressure of the insulating coolant 3 is also low, as is the case with those conventional devices. Therefore, the insulation within the container vessel 1 is chiefly maintained by the insulating gas 4. When the transformer is actuated or a load imposed on it becomes heavy, the temperature and the vapor pressure of the insulating coolant 3 become high owing to heat generation from the main body 2, and the total pressure of the mixed gas in the container vessel 1 rises. This increase in the pressure is detected by the pressure detector 13 to drive the compressor 9, open the gas valve 10, and forward under pressure an excessive portion of the insulating gas into the gas storage tank 7, thereby maintaining the interior of the container vessel 1 at a definite pressure level. Within the container vessel 1, the coolant 3 of a good insulating property evaporates and its partial pressure becomes high. As the consequence of this, sufficient dielectric strength can be maintained, even if the mixed gas is discharged.

In this instance, the mixed gas is sealed in the gas reservoir 7 in such a manner that it is blown by the diffuser 12 into the insulating coolant 3A which has previously been sealed in the gas reservoir 7 from the bottom part thereof. Of the mixed gas as blown into the gas reservoir, the insulating coolant 3 is liquefied by its mixing with the coolant 3A in the gas reservoir 7, and the insulating gas 4 dissolves at first into the insulating coolant 3A within a range of its solubility, a part of which collects at the upper portion of the gas reservoir 7 in a gaseous state. Upon further blowing of the mixed gas by the compressor 9, the gas pressure within the gas reservoir 7 rises, in proportion to which the solubility also increases, whereby much more insulating gas 4 dissolves into the coolant 3A, while maintaining equilibration with the gas pressure in the gas reservoir.

Incidentally, during the above-described operations, the insulating coolant 3 contained in the mixed gas is liquefied, which causes the liquid surface level in the gas reservoir 7 to rise. This rise in the liquid surface level is detected by the liquid surface detector 8. When the liquid surface level reaches its upper limit value (a level b in FIG. 2), the liquid valve 11 is opened by controlling action of the control device 20 to return a part of the insulating coolant 3A to the container vessel 1. When the liquid surface level reaches its lower limit value (a level b in FIG. 2), the liquid valve 11 is closed. In this manner, the liquid surface of the insulating coolant 3A can always be maintained at a certain definite range of its level.

On the other hand, when the load to the transformer is reduced, heat generation from the transformer main body 2 decreases with the consequence that the temperature of the insulating coolant 3 in the container vessel 1 and the inner pressure of the container vessel 1 are both decreased. In order to prevent the dielectric strength from lowering by the decrease in temperature and pressure, reduction in the gas pressure in the container vessel 1 to a value below a given one is detected by the pressure detector 13, the gas valve 14 is opened by the control device 20 to return the insulating gas from the gas reservoir 7 to the container vessel 1, and, as soon as the gas pressure in the container vessel reaches a definite value, the gas valve 14 is closed. In this instance, the pressure in the gas storage tank 7 is higher than that in the container vessel 1, on account of which, if the gas valve 14 is opened, the insulating gas in the upper part of the gas storage tank 7 is first sent back into the container vessel. As the gas pressure in the gas storage tank 7 becomes gradually low, the solubility of the insulating gas 4 into the coolant 3A decreases accordingly, whereby the insulating gas which has so far been dissolved in the coolant 3A isolates and collects in the upper part of the gas storage tank 7, and becomes able to be returned to the container vessel 1 in sequence. Further, if necessary, a second compressor **9*b* as an expedient of feeding the gas from the gas storage tank 7 toward the container vessel 1, may be connected to the gas valve 14 in the piping system so that the gas in the gas storage tank 7 can be effectively returned. With the construction, the capacity of the gas storage tank 7** can be fairly reduced.

The foregoing are explanations on the operations of the cooling and insulating system for the electromagnetic induction appliance according to one embodiment of the present invention. By thus constructing and operating the system, it becomes possible that, when the solubility of the insulating gas 4 into the insulating coolant 3A is high, a much larger quantity of the insulating gas can be stored in the gas storage tank 7 than the insulating gas 4 in its gaseous form can be stored therein. As the consequence of this, a volume of the gas storage tank 7 can be reduced. For instance, if fluorocarbon ($C_8F_{16}O$) is used as the insulating coolant 3A and sulfur hexafluoride ($SF_6$) as the insulating gas, the solubility of the insulating gas at a normal temperature is in a range of from a few times to ten and several times as large as a volume (in liquid) of the coolant 3A, in terms of a gas volume under the atmospheric pressure, and yet it is proportionate to the gas pressure on the liquid surface. It is therefore possible that the volume of the gas storage tank 7 be made, in theory, as small as a few fractions even under the same pressure.

Figure 3:
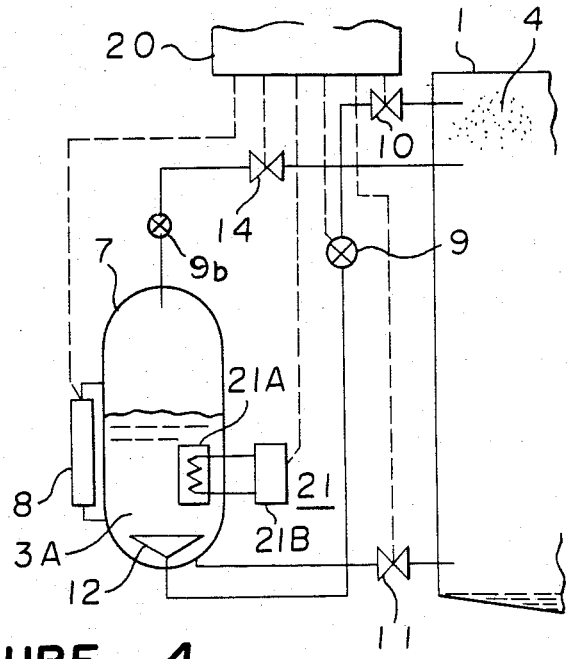
FIG. 3 is a schematic view partly in longitudinal cross-section of a main part of another embodiment of the gas insulated-transformer according to the present invention.
Figure 4:
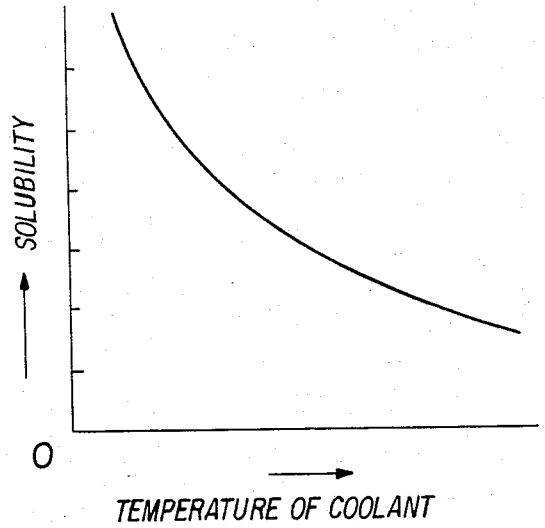
FIG. 4 is a graphical representation showing a temperature characteristic curve of a solubility to an insulating coolant of an insulating gas.

FIG. 3 shows another embodiment of the present invention. It should be noted that, in this figure of drawing, the same reference numerals as those in FIG. 2 designate the same parts. In this embodiment, there is provided a heat exchanger 21 composed of an internal unit 21A and an external unit 21B. This heat exchanger has either one or both of the refrigerator (or cooler) function and the heater function. The solubility of the insulating gas 4 into the insulating coolant 3A is high at a low temperature, while it is low at a high temperature, as shown in FIG. 4. Accordingly, by provision of the heat exchanger, the temperature rise in the insulating coolant 3A can be prevented, in the case of storing the gas, thereby making it possible to store a large quantity of the gas. Further, in the case of returning the gas from the gas storage tank 7 to the container vessel 1, the temperature of the insulating coolant 3A is elevated to accelerate isolation of the insulating gas. As such, the thermal property of the gas insulated transformer can be improved. Whether the heat exchanger 21 is to possess either the cooling function or the heating function, or both functions may be arbitrarily selected depending on the users' demand for the transformer, or kind of the coolant gas to be used.

In the foregoing explanations, the transformer is taken as an example of applying the present invention. However, it goes without saying that the present invention is also applicable to other electromagnetic induction appliances such as reactor, etc. Further, the kinds of the insulating gas and the insulating coolant are not necessary to be limited to the fluorine compound as mentioned above.

As has been described so far, the present invention exhibits remarkable effects such that it can reduce the volume of the gas storage tank by storing the insulating gas in the gas storage tank in the form of its being dissolved into the insulating coolant, and yet the gas pressure withstand of the gas storage tank and the compressive force of the compressor can be made low, hence the gas insulated electromagnetic induction appliance can be made compact in size.

Although the present invention has been described with reference to a couple of preferred embodiments thereof, it should be understood that the invention is not limited to these embodiments, but any changes and modifications may be made by those persons skilled in the art without departing from the spirit and the scope of the present invention as set forth in the appended claims.

We claim:

1. A gas insulated electromagnetic induction appliance which carries out insulation and cooling, within an operating temperature, comprising a main body principally composed of a winding and an iron core housed in a container vessel, in which a non-condensing insulating gas and a condensing insulating coolant are confined, (a) a pressure detector for detecting a pressure within said container vessel;

(b) a gas reservoir connected to said container vessel through a gas discharging passgeway including a first pipe line, a first gas valve, a first compressor, and a gas diffuser in said reservoir; a gas feeding passageway between said vessel and said reservoir including a second pipe line and a second gas valve; and a liquid feeding passageway between said vessel and said reservoir including a third pipe line and a liquid valve;

(c) a definite quantity of insulating coolant confined in said gas reservoir;

(d) a liquid surface detector for detecting a quantity of said insulating coolant in said gas reservoir; and (e) control means which controls said gas values said liquid valve, and said first compressor to thereby regulate a pressure in said container vessel and a quantity of the liquid in said gas reservoir.

2. A gas insulated electromagnetic induction appliance according to claim 1, characterized by further comprising a heat exchanger having at least one of the functions of cooling and heating the insulating coolant in said gas reservoir.

3. A gas insulated electromagnetic induction appliance according to claim 1, wherein said insulating gas is sulfur hexafluoride ($SF_6$), and said insulating coolant is fluorocarbon ($C_8F_{16}O$).

4. A gas insulated electromagnetic induction appliance according to claim 1, wherein a second compressor is connected to said second gas valve in said second pipe line from said container vessel to said gas reservoir.

* * * * *